US005213560A

United States Patent [19]

Crowley

[11] Patent Number: 5,213,560

[45] Date of Patent: May 25, 1993

[54] SYSTEM AND METHOD FOR MANUFACTURING SEALED PACKAGES

[75] Inventor: H. W. Crowley, Newton, Mass.

[73] Assignee: Roll Systems, Inc., Burlington, Mass.

[21] Appl. No.: 702,829

[22] Filed: May 20, 1991

[51] Int. Cl.[5] ..... B31B 1/24; B31B 1/62

[52] U.S. Cl. ..... 493/231; 493/332; 493/202; 493/197; 493/264; 493/208; 156/277

[58] Field of Search ..... 493/187, 188, 190, 197, 493/202, 235, 239, 254, 264, 265, 320, 325, 332, 333, 189, 190, 208, 249, 266, 336, 337, 220, 231; 156/217, 227, 277

[56] References Cited

U.S. PATENT DOCUMENTS

| | | | |
|---|---|---|---|
| 1,636,495 | 7/1927 | Widmaier | 493/254 |
| 2,242,799 | 5/1941 | Moore | 493/208 |
| 3,794,550 | 8/1972 | Taillie . | |
| 4,726,802 | 2/1988 | Volk, Jr. | 493/231 |
| 4,826,475 | 5/1989 | Eweryd | 493/208 |

FOREIGN PATENT DOCUMENTS 0193726 10/1986 European Pat. Off. .

OTHER PUBLICATIONS

Xerox Disclosure Journal, vol. 14, No. 6, Nov. 1, 1989, Stamford, Ct., pp. 315-316.

*Primary Examiner*—Bruce M. Kisliuk
*Assistant Examiner*—Jack Lavinder
*Attorney, Agent, or Firm*—Wolf, Greenfield & Sacks

[57] ABSTRACT

A system and method for constructing sealed printed packages and one-piece mailers provides fixedly applying printing toner to predetermined locations upon a first part of a face of a printable sheet. The sheet is then folded so that a second part of the face overlies the first part which includes the locations having the toner thereon. The toner is then sealed so that the first and second parts are joined together. The toner may comprise a heat activated xerographic powdered toner. The second part of the face may include toner at locations that overlap the toner upon the first part and sealing may involve preheating of the toner prior to folding and then applying additional heat and pressure to the toner by means, for example, of rollers subsequent to folding. The sheet may then be cooled.

8 Claims, 3 Drawing Sheets

SYSTEM AND METHOD FOR MANUFACTURING SEALED PACKAGES

FIELD OF THE INVENTION

This invention relates to a novel system and method for manufacturing envelopes and other printed packages and more particularly to a system and method for manufacturing one-piece mailers using sealed toner.

BACKGROUND OF THE INVENTION

It has become increasingly desirable to reduce the amount of paper required in the volume mailing of information such as bills and financial statements. As such, increasing emphasis has been placed upon the construction of "one-piece mailers" in which a single sheet of paper receives textual and other graphic information and then is subsequently folded to become a self-contained integral envelope. In order to secure the folded envelope for mailing, an adhesive material is usually applied in a separate step around the free edges. Upon folding, these edges overlap and a subsequent sealing step utilizing pressure, moisture, solvents or heat, among other influences, occurs. The particular adhesive is sensitive to a given type of sealing process.

Often, however, the adhesive is too strong to be pulled apart and, thus, owing to the integral structure of the mailer, in order to prevent damage to the textual part of the sheet, tearable perforations are subsequently cut around the sealed edges to allow ease of opening for revealing the information. Such perforations, however, result in waste of paper.

Another disadvantage of the traditional one-piece mailer sealing process is that it is generally difficult to apply glue or other adhesives after text has been added to the sheet. Thus, pregluing of each sheet at predetermined locations is necessary. The placement of the text must then be tailored to conform to the glue pattern. This tends to limit the types of text that may be included and requires significant advance planning of paper sheet size and text layout as well as storage of a large inventory of preglued sheets. As such, inventory investments become large while versatility of sheet and text patterns remains small.

Furthermore, since many adhesives are designed to activate when exposed to moisture, heat or pressure, they may be highly prone to aging. Thus, over time, the adhesive placed upon stored sheets may lose some or all of its sealing properties as the external environment activates it. In some instances, this activation may even cause stacked sheets to become permanently joined together, ruining valuable supplies of sheets. The risk of adhesive activation may, therefore, require additional expenses for more careful storage and climate control of sheet inventories.

It may also be desirable to create windows through a part of a sheet in order to expose interior text (such as an address) eliminating the need for individual marking the outer face of the sheet. In conventional envelope designs, a window is often covered with an attached transparent glassine layer to enhance the strength and protection of the envelope relative to the underlying text. An open window with no covering may be prone to tearing since it may be easily pulled upwardly away from the inside text sheet. The envelope would, thus, prove significantly more secure if the edges of the window could be tacked down to the text carrying paper.

However, adhesives are difficult to apply and seal in central areas and may damage the text.

Another disadvantage of preglued sheets is that they are more difficult to store in a large roll and to subsequently apply print to and to cut prior to sealing. The roll storage system may cause the same difficulties as found in individual stacked sheets and printing has to be accurately registered with respect to each adhesive line ahead of time or print on the entire roll of sheets may become off centered.

SUMMARY OF INVENTION

It is therefore an object of the present invention to provide a method and system for constructing envelopes and one-piece mailers which does not require the use of preapplied adhesives.

It is another object of this invention to provide a method and system for constructing envelopes and one-piece mailers that allows the application of an adhesive substance onto a sheet at the same time that text is printed thereon.

It is another object of this invention to provide a method and system for constructing envelopes and one-piece mailers that facilitates the formation of tacked-down open windows for revealing internal text.

It is another object of this invention to provide a method and system for constructing envelopes and one-piece mailers in which the degree of adhesion between sheet surfaces is easily variable.

It is yet another object of this invention to provide a method and system for constructing envelopes and one-piece mailers that facilitates their creation from printed sheets derived from a roll or similar storage medium of elongated printable material web.

A system and method for manufacturing sealed packages and one-piece mailers according to this invention features applying printer toner to a sheet of printable material at predetermined locations upon at least a first part of the face of the material. The sheet is then folded so that a second part of the face overlaps the first part. The toner is then subsequently sealed so that the first part and the second part of the face are joined together. The second part of the face may also include toner so that when the two parts are folded and sealed, the areas of toner become bonded together for a stronger bond. The toner in this particular example may be a xerographic plastic and carbon black toner and the sealing may therefore be accomplished by applying heat before, after, or during folding and applying pressure subsequent to folding. Each sheet may be cut from a continuous web which may be fed from a toner application device such as a laser printer. The sheet may include upon one part thereof a window having a pattern of toner placed around its perimeter for tacking to an opposing part of the sheet. In this manner, internal address or other information may be viewed while the sealed sheet remains relatively secure. According to this invention, folding may include half-folded, zig-zag folded and letter folded patterns among others. Of course, any face of the sheet may include toner printed text thereon applied concurrently with the application of toner at other predetermined locations such as strips on sheet edges for sealing of sheet parts together.

BRIEF DESCRIPTION OF THE DRAWINGS

The foregoing objects and advantages as well as others will become more apparent with reference to the following drawings in which.

DETAILED DESCRIPTION OF THE PREFERRED EMBODIMENTS

Figure 1:
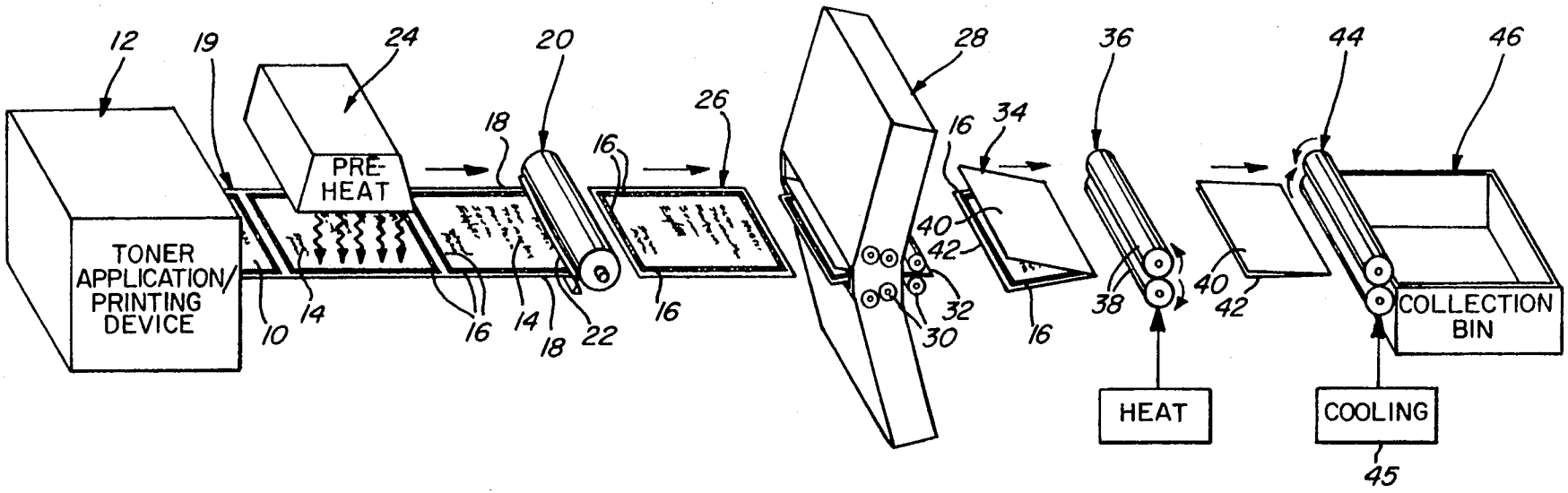
FIG. 1 is a schematic diagram of a one-piece mailer construction system according to this invention.

A system for creating one-piece mailers or similar enveloping package constructions is depicted schematically in FIG. 1. In this example, a continuous web of printable material 10, such as paper, is fed through a printing device 12 capable of applying toner. The toner of this example is the powdered carbon black and plastic heat activated printing toner used in standard xerographic and laser print applications. Such powdered toner flows, fuses and adheres to the paper only after it is "melted". Once it hardens it becomes permanently fixed to the paper. Other types of solid activated inks that utilize a softening agent such as cold fusion freon activated toner may also be employed according to this invention. The generally required feature is that the toner utilized have the ability to harden and be subsequently resoftened or reactivated at a later time. In this way the toner's natural adhesive properties may be employed to allow it to adhere to other parts of a sheet after the initial laying down of the toner. It is further desirable that the toner have a stronger affinity for itself than for the printable material once it is resoftened. As such, the low density printed text is less likely to be made to inadvertently stick to an opposing overlapping section of printed material upon reactivation and rehardening of the toner. While this description will generally make reference to paper as the printable web material and a standard xerographic plastic and carbon black toner, other types of printable web and reactivatable toners and inks are particularly contemplated according to this invention.

The printing device 12, responding to a program from, for example, a CPU, simultaneously lays down text 14 and strips 16 of adhesive acting toner at predetermined locations, which in this case are locations along side edges 18 and across the opposing side edges of the paper web 19. Thus, no separate or prior adhesive application step is necessary. Each sheet may contain its own unique adhesive strip pattern, textual pattern and folding arrangement as defined by the program. The printer is programmed to accurately register the laying down of text 14 and corresponding adhesive strips 16 so that a downstream cutter 20 accurately separates individual sheets at appropriate separation locations as defined by the printing process. The cutter in this example is a rotating helical blade 22. The actual sheet distance registration for cutting and further system operations may be performed by comparing calculated distance measurement of sheets fed into the system with the relative text and strip locations recorded by the source printer as it lays down toner. Alternatively, external marks placed upon each sheet by the printer as it lays down text and strips could be detected by the system to accurately register the sheet for cutting.

In this example, between printing and cutting, a preheat process occurs. The preheat 24 may be accomplished by infrared, flash heating or other rapid energy transfer heating devices. The preheat 24 is particularly directed to softening the heat sensitive adhesive strips 16 of toner so that they may be bonded together. Generally, the toner adhesive strips cover the paper more densely and, thus, absorb more radiation from the preheat device 24 than the much more diffuse text 14. However, a mask may also be interposed between the preheat device 24 and the textual area 14 to insure that it is not unduly softened in the preheat process. In this way only the adhesive strip locations or other selected areas of toner are fully preheated. In addition, a mask may be utilized to vary the amount of preheating applied to all or part of a particular adhesive strip if, for example, a varying degree of adhesion is desired at varying locations upon the sheet or, alternatively, if certain areas of the strip are to be exposed to other strip areas during intermediate steps of the folding process (their joining being undesirable at that time), before final adhesion of strip locations occurs.

Following the cutting of each preheated sheet, the particular sheet 26 is fed into a folding device 28. The depicted folder is known as a "buckle folder" and includes a number of rolls 30 to reorient the paper 32 so that it may be creased into a variety of fold patterns including, for example, 3 section letter, half and Z-folds. Alternatively, a standard tuck folder may be utilized. A tuck folder would have the advantage of not interfering as significantly with adhesive strips 16 since toner strip carrying edges could be isolated from each other, reducing the risk of their premature joining. As such, more complex products could be constructed including those involving non-symmetrically folded opposing edges of a sheet (See for example, FIG. 2(*c*)). For constantly variable folding capabilities, the folder may receive commands from the logic of the printer 12 or another central processor to alter the sheet fold configuration for the particular text layout presented to the folder from the printer, such as those fold patterns shown, for example, in FIGS. 2(*a–c*).

The preheated toner may be sufficiently soft so that mere folding results in adhesion of opposing strips 16 to one another. For greater sealing pressure, or for heating more isolated areas upon a folded sheet 34 where the rest of the surrounding text should remain unheated, a sealing roller arrangement 36 having a pair of pinch rollers 38 may be employed downstream of the folder 28. The sealing roller arrangement 36 may be heated in either localized areas or over entire surfaces of one or both of the pinch rollers 38 so that toner on given areas of the folded sheet 34 becomes both melted and compressed between the two pinching rollers 38. Even if heat is only utilized in certain localized areas of roller surfaces, or not at all, the pressure of the pair of pinching rollers 38 still serves to more securely seal together any preheated toner strips 16 upon opposing sheet surfaces 40, 42.

A second set of cooling rollers 44 are also utilized in this example in a position downstream from the sealing rollers 36. The pair of pinching cooling rollers 44 provide additional sealing pressure while the toner cools to a hardened state. The cooling may also include venturi jets of air and similar rapidly operating heat removal devices 45.

Downstream of the cooling rollers, each folded and sealed mailer is collected. In this example a collection bin 46 is utilized in which completed one-piece mailers are stacked.

Figure 2A:
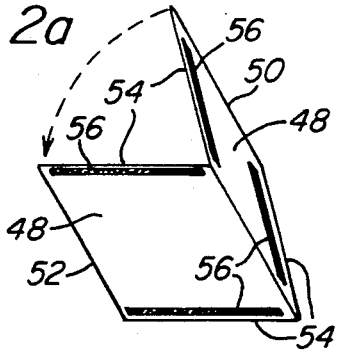
FIGS. 2(*a–c*) are perspective views of examples of possible one-piece mailer folding arrangements according to this invention.
Figure 2B:
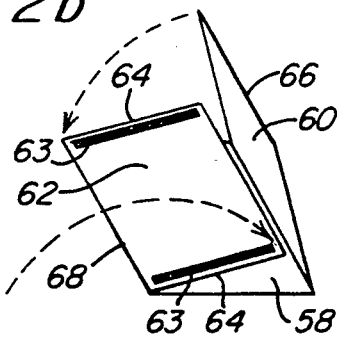
Figure 2C:
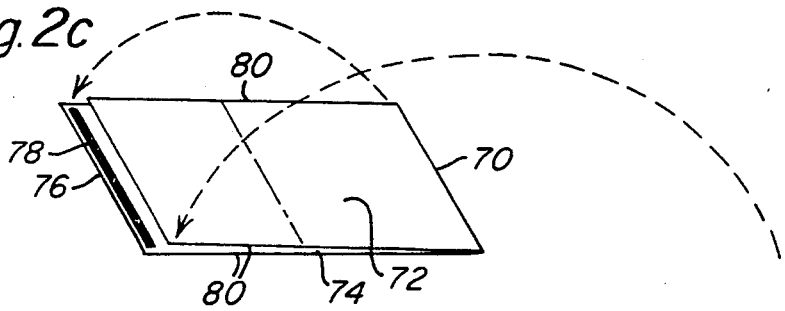

Some particular examples of folded sheets for constructing one-piece mailers having toner strips for sealing appear in FIGS. 2(*a–c*). In the most basic pattern, as shown in FIG. 2(*a*), a sheet is folded into equal length halves 48 with an edge 50 of one half aligned with an opposing edge 52 of another half. The respective side edges 54 of each half include a toner strip 56. Upon heating and folding of the halves 48 into an overlapping position, the partially melted toner of each strip on one half flows into the partially melted toner of the opposing half's strip resulting in a secure bond.

FIG. 2(*b*) depicts a more complex fold arrangement in which three relatively even length sections 58, 60, 62 are folded together. According to this example, the adhesive toner strip 63 is disposed only along one section's 62 side edges 64. The opposing section 60 is folded to overlay this adhesive stripped section 62 with its outer edge 66 flush against the stripped section's 62 fold edge 68. It is possible to seal raw un-toner stripped paper to a sufficiently thick opposing toner strip. For proper sealing, adequate heat and pressure must be provided to the joint so that the toner from the strip melts and flows sufficiently to grip into the opposing raw untonered section (60). To this end, localized heating by means of a sealing roller (36) may be required.

The bond achieved with use of only a one-sided toner strip is generally weaker than two than that of opposing toner strips of like density. But such a one sided strip is sufficient for removably adhering folded sections together when later opening of the mailer is contemplated.

Alternatively, toner could be applied to the overlapping section 60 to establish a toner-to toner joint, but in this example it would require a printer capable of two-sided printing upon a sheet. It might also be necessary to provide preheating to opposing sides of the sheet in this instance.

FIG. 2(*c*) depicts an even more complex fold arrangement utilizing unequal fold lengths and secondary folding of overlapping sections. An initial fold of the sheet occurs along an edge 70 that results in unequal sections 72, 74 as shown. Subsequently, the unequal sections 72, 74 are again folded so that the first fold edge 70 overlaps an outer edge 76 of the lower section 74 upon which is disposed a single strip 78 of adhesive toner. As in the example of FIG. 2(*b*), the single strip 78 should be sufficiently thick so that appropriate heat and pressure ensures complete sealing against the overlapping unstripped first fold edge 70. In this example, the printer (12) could additionally apply toner to side edges 80 to seal the first and second initial unequal length sections 72, 74. Note, that such a multiple fold arrangement enables the construction of one-piece mailers from substantially longer individual sheets that carry substantially larger quantities of information. Additionally, since the toner strip 78 appears upon only one edge 76, this arrangement necessitates the dedication of significantly less sheet space to adhesive strips.

Figure 3A:
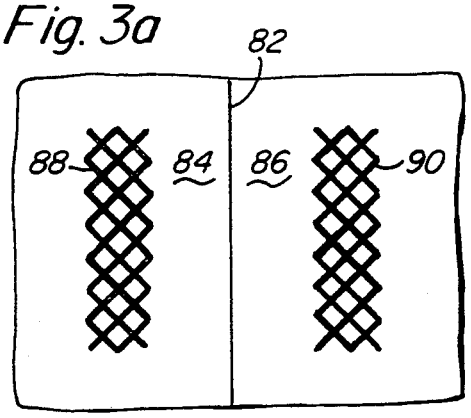
FIGS. 3(*a–c*) are top views of examples of toner adhesive strip patterns for use with one-piece mailers and envelopes according to this invention.
Figure 3B:
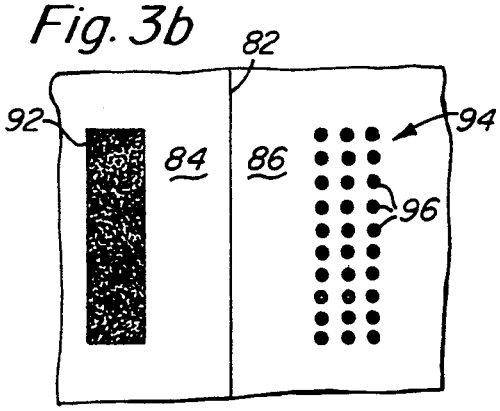
Figure 3C:
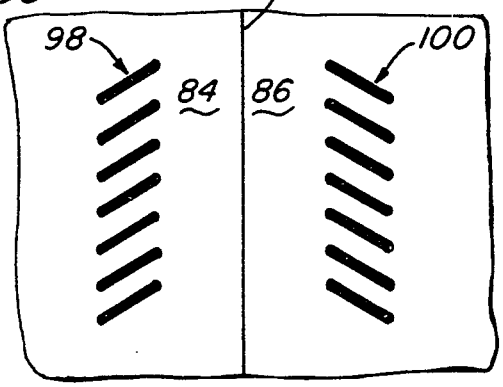

As noted above, altering the degree of toner heating (temperature versus time) may be employed to vary the adhesive strength of the bond between overlapping sheet faces. Alternatively, somewhat more accurate variation of strength may be obtained by utilizing a constant heat level and instead varying the amount of toner contained in the strip. FIGS. 3(*a–c*) depict examples of toner adhesive strip patterns that allow the variation of overall toner density which consequently enables the variation of adhesive strength per unit of sheet area.

FIG. 3(*a*) depicts a top view looking down onto a page having a fold 82 between opposing sections 84, 86 thereof. The adhesive toner strips upon each section 84, 86 comprise sets of cross-hatched lines 88, 90 of toner. When the toner of each cross-hatched strip 88, 90 is reheated and pressure is applied to overlapping folded sections 84, 86, the interaction of one set of cross-hatched lines with opposing cross-hatchings (and each set of lines with unprinted parts of the overlapping surface) results in a somewhat firm but detachable joint. The joint is generally strongest where overlapping cross-hatches of each surface touch (a toner to toner bond). Thus, increasing the density of cross-hatchings 88, 90 upon one or both of the surfaces 84, 86 serves to increase the strength of the joint.

A second example of an adhesive toner strip pattern placed upon opposing sections 84, 86 of a folded sheet is shown in FIG. 3(*b*). In this example the left strip 92 comprises a relatively solid bar of toner while the right strip 94 comprises a group of spaced apart dots 96 of toner that overlay the solid strip 92 when the two sections 84, 86 are folded into an overlapping position. Unlike cross-hatchings (FIG. 3(*a*)), each dot 96 is generally guaranteed to land upon some section of the solid toner strip 92. Thus, an accurate graduation of bond strength is possible since a relatively complete toner-to toner bond is assured in this arrangement. Additionally, the solid toner strip 92 will also bond to the unprinted parts of the opposing section 86 surface provided that sufficient heat and pressure are utilized in sealing. The dot and solid bar arrangement has an advantage in that the density of dots 94 directly controls the adhesive strength since each dot 96 may be counted upon to lay upon and fuse into the opposing solid strip 92 upon reactivation of the toner. Note that X's, squares, and other geometric shapes may be easily substituted for dots according to this example.

A third example of an adhesive strip pattern appears in FIG. 3(*c*). In this example, two mirror image sets of diagonal slashes 98, 100 are disposed in line upon opposing sections 84, 86 of a folded sheet. When the sections are brought into overlapping contact by folding, the sets of slashes 98, 100 cross one another to seal at their crossing points. Of course, if sufficient heat and pressure are applied, unprinted areas of each overlapping section are also sealed to each opposing section s slash. The strength of the bond in such an arrangement may be controlled by increasing the number of slashes, the size of each individual slash, or both.

Figure 4:
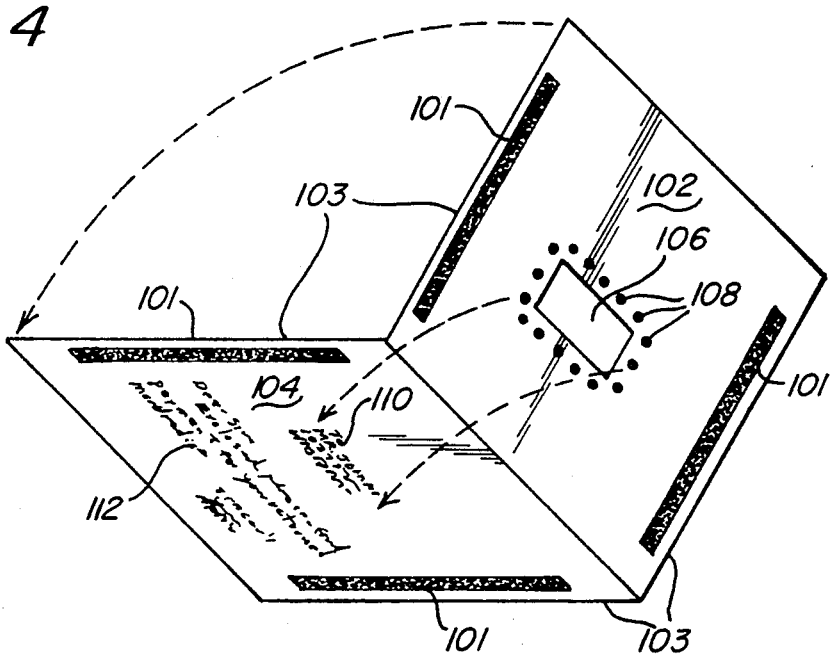
FIG. 4 is a perspective view of a one-piece mailer according to this invention including a toner pattern for tacking down the perimeter of the window.

The reactivation of toner to enable its use as an adhesive also makes possible unique features that may be employed in conjunction with a one-piece mailer according to this invention. FIG. 4 shows a standard half folded sheet having strips 101 of adhesive toner along the side edges 103 of each half 102, 104. Additionally, a window 106 has been cut into one of the halves 102. Such windows are normally utilized when the sender desires to have mailing information such as name and address displayed while covering other important and potentially confidential information contained within the mailer. In a light-weight sheet or envelope structure it is, however, usually necessary to include a layer of transparent glassine or plastic over the window. This prevents the inadvertent tearing of the sheet along the window (which may catch upon objects as the mailer is sorted) and also prevents unauthorized viewing of other text within the mailer. Such viewing is possible since an "open" window without a layer of glassine may easily be lifted away from the text allowing an unauthorized person to peek through the window into the body of the underlying sheet.

However, by using reactivated toner printed along with the other text and disposed about the window in dots, X's or similar light density toner patterns 108, the window 106 may be subsequently tacked around the address information 110 at the same time the opposing toner strips are sealed. In the example of FIG. 4, tacking toner adhesive is disposed upon only one 102 of the two halves 102, 104 of the sheet, in particular, the half 102 carrying the window 106. However, the tacking patterns (dots) 108 could also be disposed directly around the address text 110 upon the other half 104 or could, in fact, be disposed upon both halves 102, 104. Generally, the window 106 should be tacked around the address information 110 lightly enough to allow it to pull away easily without damage to the sheet when the mailer is completely open. The window 106 should be tacked firmly enough, however, to prevent its section s inadvertent detachment from the underlying sheet during sorting and transport, and also should be tacked firmly enough to deter unauthorized viewing the interior text contents 112.

The resoftening of the window tacking toner, so that it may flow and stick to an opposing side, may be accomplished by means of preheating followed by pressure, or by a localized heating of the window area 106 using, for example, a pressurized roller (36) having isolated heating surfaces synchronized to contact each window area as a mailer passes through the roller arrangement (36).

It should be understood that the preceding is merely a detailed description of preferred embodiments. It should be apparent to those skilled in the art that various modifications and equivalents may be made without departing from the spirit or scope of the invention. The preceding description is meant to be taken only by way of example and to describe only preferred embodiments and not to otherwise limit the scope of the invention.

What is claimed is:

1. A method for constructing sealed printed packages comprising:

fixedly applying printing toner to predetermined locations upon a face of a printable material;

forming a throughcut open window upon a portion of the material at a location that enables viewing therethrough;

the step of applying including locating toner proximate an edge of the window;

folding the material so that the section having the window overlays the section having predetermined printing thereon, at least part of the printing being viewable through the window; and sealing the toner so that the overlayed sections become sealed to each other, the step of sealing including adhering the edge of the window at predetermined points therealong against an opposing face of the folded printable material to tack the window in place relative to the opposing face, the adhering of the edge including locating the toner in tacking spots so that the edge of the window can be pulled away from the opposing face with minimal letter opening force.

2. A method for constructing one-piece mailers comprising:

fixedly applying printing toner to predetermined locations upon a first part of a face of a printable sheet;

forming a throughcut open window upon a part of the face at a location that enables viewing therethrough, the step of applying further including locating toner proximate an edge of the window;

folding the sheet so that a second part of the face overlies the first part including the locations having toner thereon; and sealing the toner so that the first part and the second part are joined together, the step of sealing including adhering the edge against an opposing part of the sheet to tack the window in place relative to the opposing part, the steps of locating and sealing including tacking the window at predetermined points that are intermittently positioned about the edge so that the edge can be pulled apart from the opposing part of the sheet using substantially normal force for unfolding the sheet.

3. A system for constructing one-piece mailers comprising:

means for fixedly applying printing toner to a sheet of printable material at predetermined locations upon at least a first part of a face of the material;

means for cutting a throughcut window upon a part of the face;

means for preheating the toner to soften the toner;

means for folding the sheet so that a second part of the face overlaps the first part;

wherein the means for applying includes means for disposing a pattern of toner on the face around the window to tack a perimeter of the window to another part of the face subsequent to folding; and means for sealing the toner so that the first and the second part are joined together.

4. The system as set forth in claim 3 wherein the pattern includes one of dots, X's and squares.

5. The system as set forth in claim 3 wherein the toner upon one part of the face is a solid strip and the toner upon another overlapping part of the face is a set of repeating geometric patterns.

6. The system as set forth in claim 5 wherein the geometric patterns includes one of dots, X's and squares.

7. The system as set forth in claim 3 wherein the toner upon each of the first and second parts of the face includes cross-hatched lines.

8. The system as set forth in claim 3 wherein the toner upon the first part and the second part of the face includes strips of diagonal slashes.

* * * * *